US005242119A

United States Patent [19]

Jariyasunant

[11] Patent Number: 5,242,119

[45] Date of Patent: Sep. 7, 1993

[54] LAMINAR SPOUT ATTACHMENT

[76] Inventor: Vichai Jariyasunant, 20329 Winkler Ave., Lakewood, Calif. 90715

[21] Appl. No.: 819,802

[22] Filed: Jan. 13, 1992

[51] Int. Cl.[5] ..... B05B 1/34; E03C 1/086

[52] U.S. Cl. ..... 239/590.3; 239/590.5

[58] Field of Search ..... 239/462, 428.5, 552, 239/553-553.5, 558, 560, 561, 575, 590.3, 590.5

[56] References Cited

U.S. PATENT DOCUMENTS

| | | | |
|---|---|---|---|
| 2,395,621 | 2/1946 | Funke | 239/590.3 |
| 2,811,340 | 10/1957 | Aghnides | 239/428.5 |
| 3,554,451 | 1/1971 | Aghnides | 239/428.5 |
| 3,630,444 | 12/1971 | Nelson | 239/590.3 |
| 3,995,664 | 12/1976 | Nelson | 138/43 |
| 4,119,276 | 10/1978 | Nelson | 239/590.3 |
| 4,667,349 | 5/1987 | Son | 239/575 |
| 4,730,786 | 3/1988 | Nelson | 239/590.3 |

*Primary Examiner*—Andres Kashnikow
*Assistant Examiner*—Karen B. Merrith
*Attorney, Agent, or Firm*—Jeffrey G. Sheldon

[57] ABSTRACT

A laminar stream spout attachment for faucets comprises a plurality of spaced-apart parallel perforated plates and associated screens. The perforated plates reduce flow velocity and distribute the flow uniformly across the attachment. The screens operate to trim the stream and reduce the associated flow noise, thus providing a high-quality stream which is clear, straight, free of mist and spray, quiet, soft and essentially splash-free with a minimal number of parts.

17 Claims, 1 Drawing Sheet

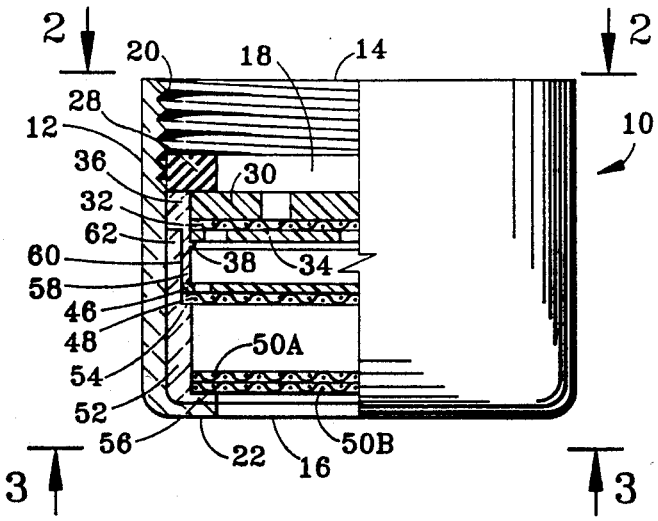
FIG. 1
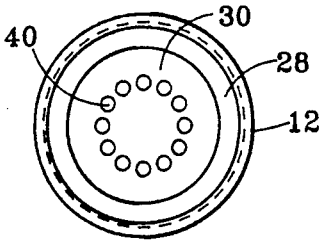
FIG. 2
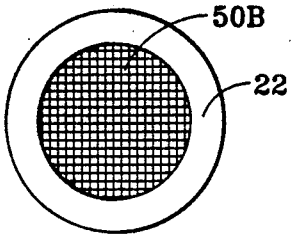
FIG. 3
FIG. 4
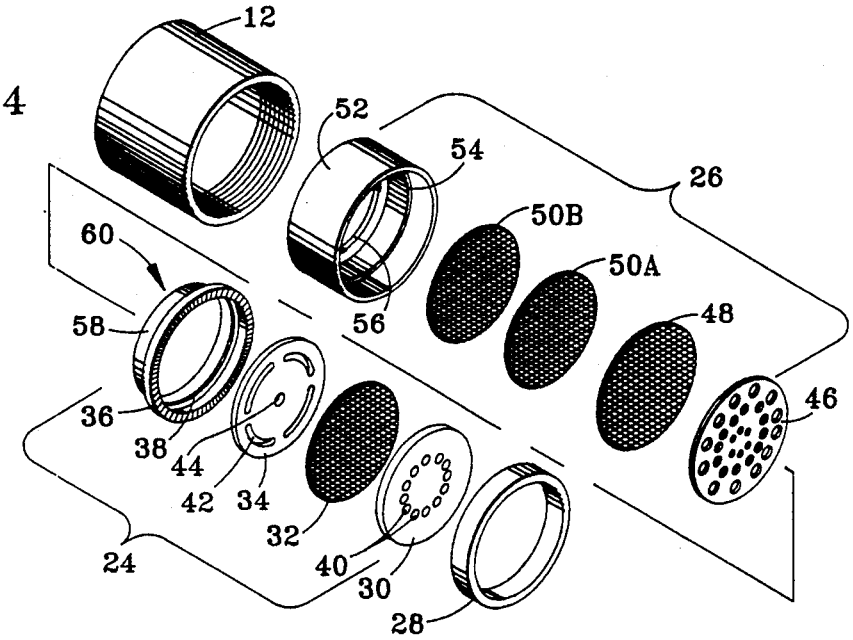
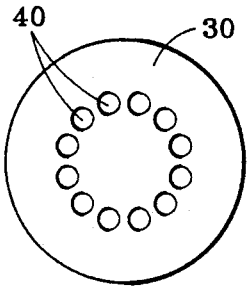
FIG. 5
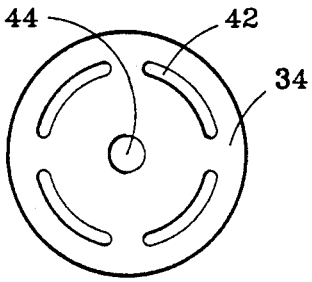
FIG. 6
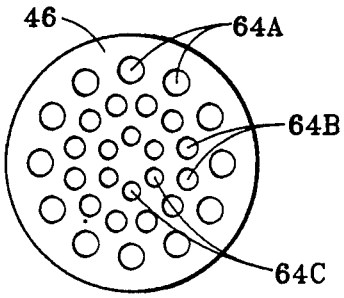
FIG. 7

LAMINAR SPOUT ATTACHMENT

BACKGROUND

This invention relates to a spout attachment which modifies the stream of fluid flowing through a faucet to produce a laminar stream.

Existing spout attachments operate to modify the nature or quality of the stream emanating from a spout by aerating the stream, reducing the turbulence of the stream, or otherwise changing its characteristics as it flows through the attachment. Recent trends in water conservation have prompted manufacturers to include a flow-limiting (also known as restricter) plates in their assemblies. However, the flow-limiting plates accelerate the liquid and generate fluid and plumbing noise. The prior art, particularly U.S. Pat. Nos. 3,995,664, 4,119,276, and 4,730,786, have attempted to remedy this problem with complex and expensive attachments incorporating perforated plates and spaced apart screens. Due to the complexity and expense of these attachments, their acceptance has been limited.

Therefore, there is a need for a spout attachment that provides a high-quality, non-aerated stream which is clear, free of mist, spray or other turbulence, so soft that it is essentially splash-free and quiet, where the attachment is less expensive and complex than available alternatives.

SUMMARY

The present invention provides an attachement that meets these needs. The attachment comprises a cylindrical housing having an inlet end adapted for coupling to a spout and an outlet end. The housing defines a flow passage connecting the ends. A flow-limiting plate is mounted in the housing for controlling the volume of liquid flowing through the flow passage. The flow-limiting or restricter plate has a plurality of apertures. A screen is disposed in the body downstream from the flow-limiting plate. This screen permits liquid to flow therethrough while abating the noise associated with the liquid flow. Located in the housing downstream from the screen is a velocity-reducing plate. The velocity-reducing plate comprises a plurality of orifices forming a segmented annular ring concentrically aligned with the center of the velocity-reducing plate. These orifices are not axially aligned with the apertures of the flow-limiting plate so that the liquid flowing through the laminar spout attachment must alter direction twice by 90 degrees to pass through the velocity-reducing plate. This disperses the liquid, reduces its associated pressure, and abates the liquid's flow noise.

The aforementioned laminar spout attachment preferably comprises a distributor plate. This distributor plate is located in the housing downsteam of the velocity-reducing plate. It comprises at least two groups of orifices, the orifices of each group being the same size and equidistant from the center of the distributor plate. Each orifice is larger in size than any other orifice that is closer to the center of the distributor plate. The distributor plate results in further deceleration and more even distribution of the liquid flow.

DRAWINGS

These and other features, aspects, and advantages of the present invention will become better understood with reference to the following description, appended claims, and accompanying drawings where:

FIG. 1 is a partial transverse sectional view of a laminar spout attachment device embodying features of the present invention;

FIG. 2 is a top plan view of the laminar spout attachment of FIG. 1 as seen along line 2—2 in FIG. 1;

FIG. 3 is a bottom plan view of the laminar spout attachment device of FIG. 1 as seen through line 3—3 in FIG. 1;

FIG. 4 is an exploded perspective view of the laminar spout attachment of FIG. 1;

FIG. 5 is a front elevation view of the flow-limiting plate of the laminar spout attachment of FIG. 1;

FIG. 6 is a front elevation view of the velocity-reducing plate of the laminar spout attachment of FIG. 1; and FIG. 7 is a front elevation view of the distributor plate of the laminar spout attachment of FIG. 1.

DESCRIPTION

With reference to the drawings, a laminar spout attachment 10 embodying features of this invention comprises a cylindrical housing 12 having an inlet end 14, an outlet end 16, and a flow passage 18 therebetween. The inlet end 14 has internal threads 20 for attachment to a faucet spout (not shown). The outlet end 16 has an inwardly projecting flange 22.

Contained within the housing 10 are an upstream removable assembly 24 and a downstream removable assembly 26, with the downstream removable assembly 26 seated against the outlet end flange 22. The inlet end of the housing 12, immediately downstream of the threads 20, is provided with an internal rubber gasket or washer 28.

The upstream removable assembly 24 comprises, from the upstream end to the downstream end, a restricter plate 30, a first screen 32, a velocity-reducing plate 34, and a hollow cylindrical retainer 36. The restricter plate 30, the first screen 32, and velocity-reducing plate 34 all fit into the retainer 36, and are retained therein by an inwardly projecting lip 38 on the inside wall of the retainer 36.

The restricter plate 30 extends transversely across the flow passage 18. As best seen in FIG. 5, the restricter plate 30 has a plurality of apertures 40 forming a circular array, the circular array having as its center the longitudinal axis of the attachment 10. The restricter plate 30 is a conventional plate used to reduce the volume of water flowing through the attachment, principally for the purpose of satisfying water conservation requirements. As discussed above, the restricter plate 30 generates undesirable noise.

The first screen 32, which is between the restricter plate 30 and the velocity-reducing plate 34, serves to abate noise associated with the liquid flow. The first screen 32 is shown as being flush with the restricter plate 30, but can be, if desired, spaced apart.

The velocity-reducing plate 34 extends transversely across the flow passage 18. As best seen in FIG. 6, the velocity-reducing plate 34 has a plurality of elongated arc-shaped orifices 42 therethrough forming a segmented annular ring concentrically aligned with the center of the velocity-reducing plate 34. These orifices are not aligned with the apertures 40 of the restricter plate 30. Accordingly, liquid flowing through the laminar spout attachment 10 must alter direction twice by 90° to pass through the velocity-reducing plate 34. This tortuous flow path for the liquid results in dispersement of the liquid, a reduction of its associated pressure, and abatement of the flow noise of the liquid. The velocity-reducing plate 34 may include a central flow trimming orifice 44.

Preferably, the total surface area of the orifices 42 (excluding the optional trimming orifice 44) is from about 1 to about 10 percent of the surface area of the velocity-reducing plate, and more preferably is about 4 percent. Whenever the term "surface area" is used herein with reference to an element of the attachment 10, there is meant the surface area of one side of the element.

The downstream removable assembly 26 comprises, starting at the upstream end, a distributor plate 46, a second screen 48, a plurality of screens 50, and a hollow cylindrical retainer 52. The hollow retainer 52 receives inside it the distributor plate 46, second screen 48, and the plurality of screens 50. The second screen 48 seats against an internal lip 54 on the inside wall of the retainer 52, with the downstream side of the distributor plate 46 flush with the upstream side of the second screen 48. The plurality of screens, which in the version of the invention shown in the figures, comprises two screens, namely upstream screen 50A and downstream screen 50B, and are retained by a flange 56 at the downstream end of the retainer 52. The retainer 52 is maintained within the housing 10 by the outlet end flange 22 of the housing.

The upstream assembly retainer 36 comprises a depending, annular flange 58 depending from a main body portion 60, and may be molded including the velocity-reducing plate 34 in its construction. The flange 58 is sized to fit into the upstream end of the downstream retainer 52, with the main body portion 60 of the upstream retainer 36 seated against the upstream edge 62 of the downstream retainer 52. Thus, the upstream assembly 24 seats snugly into the downstream assembly 26.

The distributor plate 46 extends across the flow passage 18. As best seen in FIG. 7, the distributor plate 46 has a plurality of orifices 64, arranged in a plurality of groups. In the version shown in FIG. 7, there are three groups of orifices, namely a first group of orifices 64A, a second group of orifices 64B, and a third group of orifices 64C. The first group of orifices 64A are furthest away from the center of the distributor plate 46, the third group of orifices 64C are closest to the center of the plate 46, and the second group of orifices 64B are therebetween.

The orifices of each group are of the same size, i.e., all of the orifices 64A are the same size, all of the orifices 64B are the same size, and all of the orifices 64C are the same size. All of the orifices of the same group are equidistant from the center of the distributor plate. In addition, each orifice is larger in size than any other orifice that is closer to the center of the distributor plate. In other words, all of the orifices 64A are larger in size than the orifices 64B, and all of the orifices 64B are larger in size than the orifices 64C. Each orifice, preferably, as shown in FIG. 7, is circular.

The surface area of the orifices 64 in total is from about 15 to about 25 percent, and preferably from about 17 to about 23 percent, of the total surface area of one side of the distributor plate.

Preferably, the distributor plate 46 is mounted in the housing 12 at least 0.07 inches downstream from the velocity-reducing plate 34 to assure even distribution of liquid across the distributor plate 46. The distributor plate 46 serves to decelerate and evenly distribute the liquid flowing therethrough.

The second screen 48 serves to trim the liquid flow and abate noise associated with the liquid flow. Preferably, the second screen 48 is flush with the distributor plate 46 as shown in the figures, but alternatively, can be spaced apart from the distributor plate 46.

Preferably, the screens 50 are at least 0.09 inches downstream from the distributor plate 46 to trim the liquid flow. Less preferably, the screens can be mounted closer to the distributor plate 46, but in such a configuration, more screens are required to achieve a satisfactory trimming affect. The screens 50 provide the final trimming of the liquid flow to ensure that the liquid flow is laminar.

The rubber gasket 28, in addition to preventing liquid seepage, serves to retain the upstream removable assembly 24 within the housing 12, and serves to hold the upstream 24 and downstream 26 assemblies together.

The components of the present invention can be formed from metal and/or a plastic, such as a nylon. Metal pieces tend to be more durable, but through injection molding, plastic pieces tend to be less expensive. Preferably, the housing 12 is made of stainless steel, and the screens, the distributor plate, and the velocity-reducing plate are made out of metal such as stainless steel, with the remaining parts injected and molded from celcon-type plastic.

The present invention has significant advantages. Because both the upstream 24 and downstream 26 assemblies are removable, cleaning and repair can easily be effected without needing to replace the entire assembly 10. Moveover, through the use of the unique velocity-reducing plate and distributor plate and due to the appropriate placement of screens, a laminar flow is achieved with a minimum number of parts. Fewer parts are required for the attachment device 10 than for prior art devices, therefore adding to the economy and usefulness of the present invention.

Althrough the present invention has been described in considerable detail with reference to certain preferred versions thereof, other versions are possible. Therefore the spirit and scope of the pending claims should not be limited to the description of the preferred versions contained herein.

What is claimed:

1. A laminar spout attachment comprising:

(a) a cylindrical housing having an inlet end adapted for coupling to a spout and an outlet end, the housing defining a flow passage connecting the ends;

(b) a flow-limiting plate mounted in the housing for controlling the volume of liquid flowing through the flow passage, the flow-limiting plate having a plurality of apertures;

(c) a first screen mounted in the housing downstream from the flow-limiting plate, the first screen permitting liquid flow therethrough while abating noise associated with the liquid flow noise; and (d) a velocity-reducing plate located in the housing downstream from the first screen, the velocity-reducing plate having a plurality of orifices therethrough forming a segmented annular ring concentrically aligned with the center of the velocity-reducing plate, wherein.the orifices are not axially aligned with the apertures of the flow-limiting plate so that the liquid flowing through the laminar spout attachment must alter direction twice by 90 degrees to pass through the velocity-reducing plate for dispersing the liquid, reducing its associated pressure and abating the liquid's flow noise.

2. The laminar spout attachment of claim 1 further comprising a distributor plate located in the housing downstream of the velocity-reducing plate, the distributor plate comprising a plurality of groups of orifices, the orifices of each group being the same size and being equi-distant from the center of the distributor plate, each orifice being larger in size than any other orifice that is closer to the center of the distributor plate;

wherein the distributor plate decelerates and evenly distributes the liquid flow.

3. A laminar spout attachment comprising:

(a) a cylindrical housing having an inlet end adapted for coupling to a spout and an outlet end, the housing defining a flow passage connecting the ends;

(b) a flow-limiting plate mounted in the housing for controlling the volume of liquid flowing through the flow passage, the flow-limiting plate having a plurality of apertures;

(c) a first screen mounted in the housing downstream from the flow-limiting plate, the screen permitting liquid flow therethrough while abating noise associated with the liquid flow noise; and (d) a distributor plate mounted in the housing downstream from the flow-limiting plate, the distributor plate comprising a plurality of groups of orifices, the orifices of each group being the same size and being equi-distant from the center of the distributor plate, each orifice being larger in size than any other orifice that is closer to the center of the distributor plate;

wherein the distributor plate decelerates and evenly distributes the liquid flow.

4. A laminar spout attachment, as defined in claim 1 or 3, wherein the apertures of the flow-limiting plate are arranged in a circular array.

5. A laminar spout attachment, as defined in claim 1 or 3, wherein the flow-limiting plate mounted in the housing is removable.

6. A laminar spout attachment, as defined in claim 1 or 3, wherein the first screen is flush with the upstream flow-limiting plate.

7. A laminar spout attachment, as defined in claim 1 or 2, wherein the area of the orifices of the velocity-reducing plate is less than about 10% of the total surface area of the velocity-reducing plate.

8. A laminar spout attachment, as defined in claim 1 or 2, wherein the orifices of the velocity-reducing plate are about 4% of the total surface area of the velocity-reducing plate.

9. A laminar spout attachment, as defined in claim 2, wherein the distributor plate is mounted in the housing at least 0.07 inches downstream from the velocity-reducing plate.

10. A laminar spout attachment as defined in claim 2, wherein the surface area of the orifices in the distributor plate are from about 17 to about 23% of the total surface area of the distributor plate.

11. A laminar spout attachment, as defined in claim 2 or 3, wherein a second screen is mounted in the housing downstream from the distributor plate, the second screen permitting liquid flow therethrough while trimming the liquid flow and abating the noise associated with the flow noise.

12. A laminar spout attachment, as defined in claim 11, wherein the second screen is flush with the upstream distributor plate.

13. A laminar spout attachment, as defined in claim 11, wherein the second screen is spaced apart from the upstream distributor plate.

14. A laminar spout attachment, as defined in claim 2, wherein the flow-limiting plate, the first screen, the velocity-reducing plate and the distributor plate form a removable assembly mounted in the housing.

15. A laminar spout attachment, as defined in claim 2 or 3, which includes: a series of at least two further screens mounted in the housing downstream from the distributor plate.

16. A laminar spout attachment, as defined in claim 2 or 3, which includes: a series of at least two further screens which are mounted in the housing at least 0.09 inches downstream from the distributor plate.

17. A laminar spout attachment comprising:

(a) a cylindrical housing having an inlet end adapted for coupling to a spout and an outlet end, the housing defining a flow passage connecting the ends;

(b) a flow-limiting plate mounted in the housing for controlling the volume of liquid flowing through the flow passage, the flow limiting plate having a plurality of apertures;

(c) a first screen mounted in the housing downstream from the flow-limiting plate, the first screen permitting liquid flow therethrough while abating noise associated with the liquid flow noise;

(d) a velocity-reducing plate located in the housing downstream from the first screen, the velocity-reducing plate having a plurality of orifices therethrough forming a segmented annular ring concentrically aligned with the center of the velocity-reducing plate, wherein the orifices are not axially aligned with the apertures of the flow-limiting plate so that the liquid flowing through the laminar spout attachment must alter direction twice by 90 degrees to pass through the velocity-reducing plate for dispersing the liquid, reducing its associated pressure and abating the liquid's flow noise;

(e) a distributor plate, located in the housing downstream from the velocity-reducing plate, the distributor plate comprising a plurality of groups of orifices, the orifices of each group being the same size and being equi-distant from the center of the distributor plate, each orifice being larger in size than any other orifice that is closer to the center of the distributor plate, wherein the distributor plate decelerates and evenly distributes the liquid flow;

(f) a series of at least two further screens mounted in the housing downstream from the distributor plate;

(g) a removable assembly mounted in the body, housing the flow-limiting plate, the first screen, the velocity-reducing plate, the distributor plate, and the series of at least two further screens downstream from the distributor plate; and (h) a means for securing the removable assembly in the housing.

* * * * *